United States Patent [19]

Aykut

[11] 4,440,051

[45] Apr. 3, 1984

[54] APPARATUS FOR CUTTING AND TRANSPORTING SHEETS OF PAPER OR THE LIKE

[75] Inventor: Kurt Aykut, Hamburg, Fed. Rep. of Germany

[73] Assignee: E.C.H. Will (GmbH & Co.), Hamburg, Fed. Rep. of Germany

[21] Appl. No.: 391,469

[22] Filed: Jun. 23, 1982

[30] Foreign Application Priority Data

Jul. 30, 1981 [DE] Fed. Rep. of Germany ..... 3130025

[51] Int. Cl.[3] ..... B26D 1/62; B65H 35/08

[52] U.S. Cl. ..... 83/72; 83/154; 83/155; 83/358

[58] Field of Search ..... 83/72, 154, 155, 358, 83/373; 271/273, 275

[56] References Cited

U.S. PATENT DOCUMENTS

| | | | |
|---|---|---|---|
| Re. 27,768 | 10/1973 | Deslauriers | 83/152 X |
| 3,192,807 | 7/1965 | Haselow et al. | 83/152 X |
| 3,446,103 | 5/1969 | Foster | 83/155 X |
| 4,189,965 | 2/1980 | Kollann | 83/155 |
| 4,201,102 | 5/1980 | Rudszinat | 83/298 |
| 4,255,998 | 3/1981 | Rudszinat | 83/299 X |

*Primary Examiner*—Frank T. Yost
*Attorney, Agent, or Firm*—Peter K. Kontler

[57] ABSTRACT

Apparatus for subdividing a paper web into a series of discrete sheets and for transporting the sheets to a processing station has a cross cutter whose knife holders can be driven at several speeds, and a sheet intercepting device downstream of the nip of the holders. The position of the entire intercepting device is changed in automatic response to changes in the speed of the knife holders to ensure that the inlet of the intercepting device can receive the leaders of successive sheets, even though the direction of advancement of such leaders is likely to change, e.g., in response to more or less pronounced curling, as a result of acceleration or deceleration of the knife holders and as a function of the thickness and/or composition of the web.

19 Claims, 1 Drawing Figure

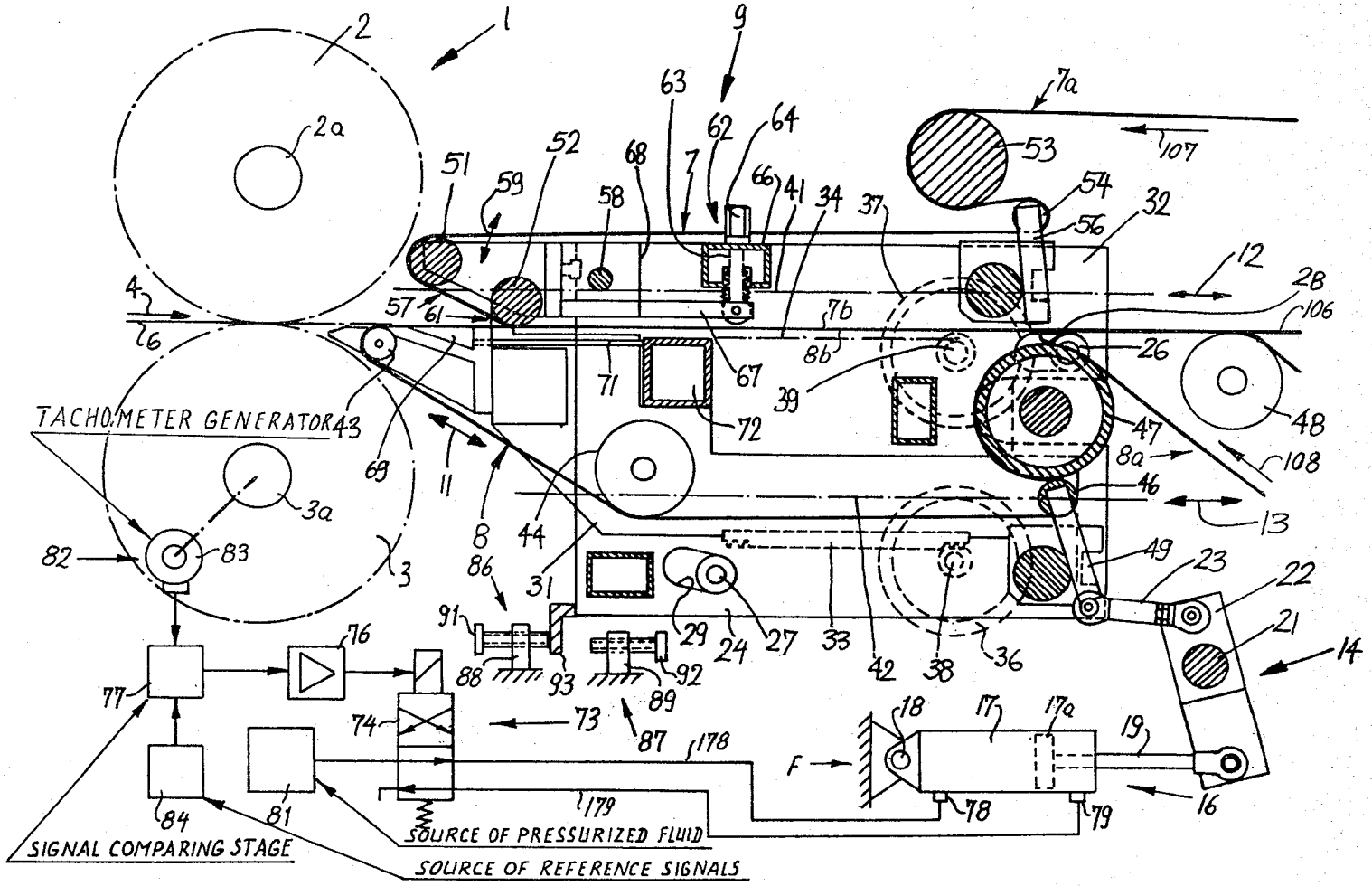
TACHOMETER GENERATOR
SOURCE OF PRESSURIZED FLUID
SOURCE OF REFERENCE SIGNALS
SIGNAL COMPARING STAGE

APPARATUS FOR CUTTING AND TRANSPORTING SHEETS OF PAPER OR THE LIKE

CROSS-REFERENCE TO RELATED CASE

Certain details of the apparatus which is described and shown in the present application are similar to those in the apparatus which is disclosed in the commonly owned copending application Ser. No. 263,075 filed May 12, 1981, now U.S. Pat. No. 4,385,537 by Wolfram Wolf for "Apparatus for engaging and transporting discrete sheets of paper or the like".

BACKGROUND OF THE INVENTION

The present invention relates to apparatus for making and transporting paper sheets or the like. More particularly, the invention relates to improvements in apparatus wherein a running web of paper, foil or a like flexible material is converted into a series of successive discrete sheets which can be transported to a stacking or another processing station.

It is well known to cause a running web of paper or the like to pass through the nip of two rotary drum-shaped knife holders forming part of a cross cutter which serves to subdivide the web into discrete sheets. Such sheets are positively engaged and entrained downstream of the nip for the purpose of advancing them to the next processing station. For example, the sheet transporting means can comprise an intercepting device (also called catcher assembly) having an upper section or conveyor unit and a lower section or conveyor unit, and each such section can employ one or more endless bands, chains, belts or like conveyors which positively engage and advance successive sheets in a direction away from the nip of the knife holders. It is also known to provide such apparatus with shifting or adjusting means which can change the position of the intercepting device with reference to the cross cutter. The peripheral speed of knives at the peripheries of the knife holders is supposed to match the speed of forward movement of the running web, at least during those stages of each revolution of the knife holders when two cooperating knives approach the path of the web and are about to make a transverse cut which results in separation of a discrete sheet from the leader of the web.

Heretofore known apparatus of the above outlined character exhibit the drawback that the leaders of sheets whose material exhibits a tendency to curl are likely to advance at random in different directions so that they cannot be readily located and engaged by the conveyors of the intercepting device. The tendency of the leaders of sheets which are made of relatively thin foil, paper or other flexible material to curl or to undergo other types of undesirable deformation immediately downstream of the nip of the knife holders in the cross cutter is attributable to a number of factors, such as the generation of air currents when the knife holders are rotated at an elevated speed, the tendency of the leaders to adhere to the peripheral surface of the one or the other knife holder, the "memory" of the running web (i.e., its tendency to form convolutions due to the fact that the web is normally drawn off a reel or bobbin wherein the web is stored in convoluted form), the weight of the leader of the web and/or others. As a rule, the leader of the web and the leaders of the sheets tend to curl downwardly about an axis extending at right angles to the direction of lengthwise movement of the web. The attendant in charge of the apparatus is often required to spend a considerable amount of time in connection with adjustments of the position of the intercepting device so that the latter can properly accept successive sheets and that such sheets are properly engaged and advanced by the conveyor units of the intercepting device. The problem is aggravated when such apparatus are used in modern high-speed production lines wherein the web is driven at a very high speed and wherein the sheets should be properly transported within a rather wide range of speeds. Production lines which employ a cross cutter and an intercepting device downstream of the nip of knife holders in the cross cutter can be used for the making of steno pads, exercise books and analogous stationery products.

OBJECTS AND SUMMARY OF THE INVENTION

An object of the invention is to provide a novel and improved apparatus for cutting and transporting sheets of paper or the like in such a way that the sheets are compelled to advance along a prescribed path irrespective of minor or pronounced variations of their tendency to curl.

Another object of the invention is to provide an apparatus which ensures reliable transfer of the leaders of successively formed paper sheets or the like from a first path into a second path wherein the sheets advance to a further processing station.

A further object of the invention is to provide an apparatus wherein the leaders of successively formed thin paper sheets or similar commodities exhibiting a detectable or even highly pronounced tendency to curl are less likely to move astray during the relatively short interval of absence of positive guidance, particularly between the nip of two knife holders forming part of a cross cutter and the conveyor units of an intercepting device which is designed to positively engage and advance successive sheets to the next processing station.

An additional object of the invention is to provide the apparatus with novel and improved means for automatically conforming the position of the intercepting device to the more or less pronounced tendency of the leaders of successive sheets to curl or to undergo other types of deformation.

Still another object of the invention is to provide novel and improved means for adjusting the position of the intercepting device in an apparatus of the above outlined character.

A further object of the invention is to provide a novel and improved connection between the cross cutter of a sheet forming apparatus and the intercepting device.

Another object of the invention is to provide a novel and improved method of preventing variations in the tendency of flexible paper sheets or the like to curl from interfering with optimum transport of such sheets from the severing station to the next processing station.

The invention resides in the provision of an apparatus for manipulating webs which consist of paper or other flexible material. The apparatus comprises severing means (particularly a cross cutter) for subdividing a running web of paper or the like into a series of discrete sheets each of which has a leader normally advancing along a predetermined first path but exhibiting the tendency to leave or depart from such path, particularly as a result of more or less pronounced curling or flexing which takes place in response to changes in the speed of the running web, i.e., in response to changes in the speed of successive sheets and of at least one component of the severing means. To this end, the component of the severing means can be driven at any one of several speeds by a rotary input member such as a motor-driven shaft or the like. The apparatus further comprises a sheet intercepting device which is adjacent to the first path and includes a pair of sections (preferably an upper section and a lower section) defining a preferably (but not necessarily) horizontal second path wherein successive sheets of the series are transported in a predetermined direction, e.g., to a stacking or other processing station, shifting means which is actuatable to adjust the entire intercepting device with reference to the severing means so as to change the position of the second path relative to the first path in order to ensure that the inlet of the intercepting device can receive the leaders of successive sheets, and means for actuating the shifting means in response to changes in the speed of sheets, i.e., in response to changes in the speed of the aforementioned component of severing means.

The shifting means preferably comprises motor means (such as a fluid-operated motor, preferably a double-acting pneumatic cylinder and piston unit), and the actuating means then includes means (such as a suitable valve) for operating the motor means.

Still further, the apparatus preferably comprises guide means (particularly stationary guide means) for the intercepting device, and such guide means is preferably arranged to confine at least a portion of the intercepting device (particularly the aforementioned inlet) to a movement having a vertical component.

The actuating means can comprise a tachometer generator or other suitable signal generating means which monitors the speed of the aforementioned component of the severing means (i.e., the speed of successive sheets), and means (e.g., a signal comparing stage or a threshold circuit and an amplifier) for initiating the actuation of shifting means when the signals which are generated by the monitoring means denote that the speed of the (normally rotary) component deviates from a predetermined value. The aforementioned signal comparing stage can compare the signals which are generated by the monitoring means with a reference signal which is indicative of a nominal or standard speed of sheets. Such stage then generates further signals which are transmitted to the shifting means when the characteristics of signals which are generated by the monitoring means deviate from the corresponding characteristics of the reference signal.

The first path is or can be a horizontal or nearly horizontal path, and the shifting means can be designed to move the inlet of the intercepting device to a selected one of a plurality of different levels, e.g., to a first level which the inlet assumes when the speed of sheets increases above a nominal or average speed and a lower second level when the speed of the sheets decreases. The first level may be flush or substantially flush with the level of the discharge end of the first path.

The apparatus can be further provided with suitable abutments, stops or analogous means for limiting the extent of adjustability of the intercepting device with reference to the severing means, and such limiting means is preferably adjustable so as to enhance the versatility of the apparatus, e.g., to account for changes in the format of sheets.

The apparatus can be provided with additional or auxiliary shifting means which, rather than shifting the entire intercepting device, is designed to move at least one section of the intercepting device relative to the other section and relative to the severing means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a somewhat schematic partly elevational and partly longitudinal vertical sectional view of an apparatus which embodies the present invention.

DESCRIPTION OF THE PREFERRED EMBODIMENTS

The apparatus which is shown in the drawing comprises a severing unit 1 here shown as a cross cutter having two rotary drum-shaped knife holders 2 and 3 each of which carries one or more knives (not specifically shown) arranged to sever a running web 6 which is fed in the direction of arrow 4. The speeds of the holders 2 and 3 are synchronized in such a way that the speed of a knife on one of these holders at least approximates the speed of the cooperating knife on the other holder when such knives reach the nip of the knife holders and are about to make a transverse cut in order to separate a discrete panel or sheet 106 from the leader of the web 6. The shaft **3*a* constitutes or forms part of a variable-speed drive which can rotate the respective knife holder 3 at any one of several speeds, and the shaft 3*a* preferably transmits torque to the shaft 2*a* for the knife holder 2 through the medium of a gear, belt, chain or other transmission, not specifically shown. The knife holders 2 and 3 define a substantially horizontal first path wherein the leader of the web 6 advances toward and beyond the nip of such knife holders. The extent to which the leader of the web 6 (i.e., the leader of each of a series of successively formed sheets 106) tends to curl upwardly but normally downwardly depends on a number of variables, such as the speed of the web (and of the knife holders 2, 3 whose peripheral speed preferably matches the speed of the web 6, at least during actual severing of the web), the composition of the web, the thickness of the web, the width of the web, the intensity of air currents which are generated by the rotating knife holders 2, 3** and their orbiting knives, and/or other parameters.

The apparatus further comprises a sheet intercepting device or catcher assembly 9 which is disposed downstream of the nip of the knife holders 2, 3 and includes an upper section or conveyor unit 7 and a lower section or conveyor unit 8. In accordance with a feature of the invention, the entire intercepting device 9 (or, at the very least, its portion which is nearest to the nip of the knife holders 2 and 3) is adjustable in directions indicated by a double-headed arrow 11 in automatic response to changes in the speed of the web 6, i.e., responsive to changes in the peripheral speed of the knife holders 2, 3 and in response to changes in the speed of movement of the sheets 106. The intercepting device 9 is movable relative to the nip of the knife holders 2 and 3 in order to change the position of the path which is defined by its sections 7 and 8 relative to the path which is defined by the cross cutter 1.

The means for moving the entire intercepting device 9 relative to the cross cutter 1 in the directions indicated by the arrow 11 comprises a shifting unit 14 having a motor in the form of a double-acting pneumatic cylinder and piston unit 16. The apparatus further comprises auxiliary or additional shifting means which are respectively designed to move the sections 7 and 8 of the intercepting unit 9 in directions indicated by the double-headed arrows 12 and 13, i.e., in the longitudinal direction of the web 6, so as to move the respective sections nearer to or further away from the nip of the knife holders 2 and 3.

The cylinder 17 of the double-acting pneumatic cylinder and piston unit 16 is pivotable about the axis of a horizontal shaft 18 which is mounted in the frame F of a machine embodying the improved apparatus. The piston rod 19 of the unit 16 is articulately connected to the lower arm of a two-armed lever 22 which also forms part of the shifting unit 14 and is pivotable about the axis of a horizontal shaft 21 parallel to the shaft 18 and also mounted in the frame F. The two chambers of the cylinder 17 (at the opposite sides of the piston 17*a*) are connectable with a source 81 of pressurized gaseous fluid or with the atmosphere by way of nipples 78 and 79. The lever 22 turns clockwise when the nipple 79 admits pressurized fluid into the respective chamber while the other chamber communicates with the atmosphere, and the lever 22 is caused to pivot in the opposite direction when the nipple 78 admits compressed gaseous fluid (e.g., air) while the nipple 79 enables air to flow from the respective chamber and into the atmosphere.

The upper arm of the lever 22 is articulately connected with a link 23 which is further articulately connected with the lower right-hand portion of an upright wall or cheek 24 constituting a portion of or the entire mobile support for the intercepting device 9. For example, the device 9 can be installed between the illustrated upright wall 24 and a similar second wall (not shown) which is nearer to the observer of the drawing. Each of the walls 24 has a pair of elongated guide slots 28, 29 for fixed guide pins or studs 26, 27 which are installed in the frame F. The slot 28 is substantially horizontal, and the slot 29 is inclined substantially in the direction which is indicated by the arrow 11. It will be noted that the slot 29 is disposed at a level below the slot 28. When the lever 22 of the shifting unit 14 is pivoted, the guide pins 26, 28 cooperate with the surfaces bounding the respective slots 27, 29 to confine the entire intercepting device 9 to movements in directions indicated by the double-headed arrow 11, i.e., upwardly along a path sloping toward the nip of the knife holders 2, 3 or downwardly along a path sloping away from the knife holders. In other words, the shifting unit 14 can move the entire intercepting device 9 between a plurality of positions in each of which the inlet 61 between the sections 7 and 8 of the device 9 is disposed at a different level. This is attributable to the provision of the aforementioned sloping elongated slot 29 for the stationary guide pin 27.

The sections 7 and 8 respectively comprise discrete frames or housings 32 and 31. The aforementioned auxiliary or additional shifting means comprise an upper rack and pinion drive 34, 39 for the frame 32 and a lower rack and pinion drive 33, 38 for the lower frame 31. The rack 33 is mounted on the frame 31 and its teeth mate with the teeth of the pinion 38 which is rotatably mounted on the wall 24 and whose angular position can be changed by a hand wheel 36 so as to move the lower section 8 along a substantially horizontal path as indicated by the double-headed arrow 13. The construction and mounting of the parts of the upper rack and pinion drive 34, 39 are analogous. The pinion 39 can be rotated by a hand wheel 37 so as to cooperate with the rack 34 on the frame 32 in order to move the upper section 7 along a substantially horizontal path as indicated by the double-headed arrow 12. The upper frame 32 has ribs or other types of projections which extend into elongated guide grooves 41 of the walls 24, and the lower frame 31 has similar projections extending into the guide grooves 42 of the walls 24.

The upper section 7 comprises one or more endless band or belt conveyors 7*a* which are trained over several pulleys including those shown at 51, 52, 53 and 54. The pulley 54 is mounted at the upper end of a pivotable lever 56 which can be said to constitute a means for tensioning the conveyors 7*a*. The belt or band conveyor or conveyors 8*a* of the lower section 8 are trained over pulleys 43, 44, 46, 47 and 48. The pulley 46 is mounted at the upper end of a pivotable lever 49 which is carried by at least one of the walls 24 and serves to tension the conveyors 8*a*. Tensioning of the conveyors 7*a* and 8*a* is desirable and advantageous in view of adjustability of the respective sections 7, 8 in the directions indicated by the arrows 12, 13 and in view of adjustability of the entire intercepting device 9 in the directions indicated by the arrow 11. The exact details of the tensioning means including the levers 49 and 56 form no part of the present invention. The same holds true for the means which drive certain pulleys (e.g., the pulleys 47 and 53) in order to advance the conveyors 7*a* and 8*a* in directions indicated by the arrows 107 and 108. The reaches 7*b*, 8*b* of the respective conveyors 7*a*, 8*a* define an elongated path which receives successive sheets 106 from the path defined by the cross cutter 1 in order to advance such sheets to the next processing station, not shown.

The pulleys 51, 52 and the respective portions of the conveyors 7*a* constitute a so-called tucking or dabbing device 57 which can be said to resemble or constitute a mouthpiece and serves to define a portion of the aforementioned inlet 61, namely, a portion of a substantially wedge-like space wherein the leaders of successive sheets 106 must advance toward the reaches 7*b*, 8*b* of the respective conveyors 7*a*, 8*a*. The pulleys 51 and 52 are movable about the axis of a stationary shaft 58 which is mounted in the frame F. The directions in which the pulleys 51 and 52 can move about the shaft 58 are indicated by a double-headed arrow 59. Such adjustability of the pulleys 51, 52 renders it possible to change the configuration of the inlet 61 and hence the force with which the leaders of successive sheets 106 are engaged by the conveyors 7*a* and 8*a*. The means for changing the position of the dabbing device 57 (i.e., for moving the pulleys 51, 52 in the directions indicated by the arrow 59) comprises an adjusting mechanism 62 including a bolt 63, a nut 64, a block or housing 66 and a lever 67 which is coupled to the bolt 63 and is biased by a coil spring. The lever 67 is further connected with a block-shaped motion transmitting and supporting element 68 which carries the pulleys 51, 52 and is turnable about the axis of the shaft 58. The exact construction of the adjusting mechanism 62 forms no part of the present invention.

The material of the conveyors 8*a* is permeable to air, and the left-hand portion of their upper reach 8*b* travels above the open upper side of a suction chamber 69 which is connected with a suction manifold 72 by one or more conduits 71. Thus, that portion of the upper reach 8*b* which travels above the suction chamber 69 attracts the leader of an oncoming sheet 106 or the leader of the web 6 and steers the leader deeper into the inlet 61 and against the reach 7*b* of the upper conveyors 7*a*.

The actuating means 73 for automatically adjusting or actuating the shifting unit 14 (and more particularly for moving the piston rod 19 of the motor 16 in a direction to the left or to the right, as viewed in the drawing) comprises a solenoid-operated valve 74, an amplifier 76 which transmits signals to the solenoid of the valve 74, and a threshold circuit or signal comparing stage 77 which is connected with a source 84 of reference signals and with the output of a speed monitoring device 82 including a tachometer generator 83 and serving to monitor the RPM of the shaft 3*a* and hence the speed of the knife holders 2, 3 as well as the speed of the web 6 and sheets 106. The source 81 of pressurized gaseous fluid can constitute a blower which can supply compressed air to the valve 74. The valve 74 can connect the nipples 78, 79 of the cylinder 17 with the source 81 or with the atmosphere by way of discrete conduits 178, 179. Instead of receiving motion from the shaft 3*a*, the rotary portion of the tachometer generator 83 can be driven by the prime mover of the machine wherein the improved apparatus is installed or by any other rotary component which is driven in synchronism with the knife holders 2 and 3 so that its speed is proportional to that of the web 6 and sheets 106.

The threshold circuit or signal comparing stage 77 is designed to transmit a signal when the intensity of the signal which is transmitted by the output of the tachometer generator 83 deviates from (is less than) that of the reference signal from the source 84.

The extent to which the lever 22 can cause the entire intercepting device 9 to move in the directions indicated by the arrow 11 can be selected by adjustable limiting means or stops 86 and 87 including screws 91 and 92 meshing with stationary nuts 88, 89 provided on or secured to the frame F. The screws 91, 92 can be adjusted to select the extent of adjustability or shiftability of the intercepting device 9 with reference to the frame F. The tips of the screws 91 and 92 flank an extension 93 of one of the walls 24. In the position which is shown in the drawing, the intercepting device 9 is located at a minimal distance from the nip of the knife holders 2 and 3, namely, at a distance which is selected by appropriate adjustment of the axial position of the screw 91 relative to the associated nut 88.

The operation of the illustrated embodiment of the improved apparatus is as follows:

The various types of adjustability of the intercepting device 9 (namely, the adjustability of the entire device 9 by the shifting unit 14, the adjustability of the section 7 by the rack and pinion drive 34, 39, the adjustability of the section 8 by the rack and pinion drive 33, 38, and the adjustability of the pulleys 51, 52 by the adjusting mechanism 62) enable an operator to select an optimum position for the device 9 and its sections and pulleys so as to take into consideration a number of parameters including the type of paper which is being processed, the dimensions of the sheets 106, the flexibility of the paper, the width of the web 6, the speed of the web and/or others. The arrangement may be such that the operator adjusts the position of the intercepting device 9 at a relatively low speed of the shaft 3*a* and thereupon at the nominal or rated speed of the web 6. This renders it possible to eliminate so-called "paper stoopers" by the simple expedient of retracting the upper section 7 of the intercepting device 9 in a direction to the right, as viewed in the drawing (namely, by rotating the hand wheel 37) while the prime mover of the machine which embodies the apparatus continues to run. The "paper stoppers" develop in the space between the nip of the knife holders 2, 3 and the innermost portion of the inlet 61. Thus, all that is necessary to reach a sheet 106 which is stuck immediately downstream of the nip of the knife holders 2, 3 is to move the section 7 away from the cross cutter 1.

If the sheets 106 form a turbulent stream of discrete sheets (for example, because the cross cutter 1 generates air streams which tend to dislodge the sheets 106 from their intended path and/or because the leaders of the sheets 106 exhibit a pronounced tendency to curl), the attendant can adjust the entire intercepting device 9 in the directions which are indicated by the arrow 11 and to the extent which is determined by selected positions of the screws 91 and 92 relative to the associated nuts 88, 89. This enables the attendant to ensure that the leaders of successive sheets 106 find their way into the inlet 61 and thence into the path between the reaches 7*b*, 8*b* of the conveyors 7*a* and 8*a*. In the case of changes of format (i.e., when the dimensions of the sheets 106 are to be changed by replacing the illustrated knife holders 2, 3 with another pair of knife holders), the operator can move the lower section 8 of the intercepting device 9 toward or away from the cross cutter 1 so as to conform the device 9 to the changed operating conditions.

Proper transport of sheets 106 downstream of the cross cutter 1 further depends on the extent to which successive sheets 106 are separated from one another so that the trailing end of a preceding sheet cannot interfere with advancement of the next-following sheet between the stretches 7*b*, 8*b* of the conveyors 7*a* and 8*a*. The width of gaps between successive sheets 106 can be selected by varying the speed of the conveyors 7*a*, 8*a*, i.e., the width of the gaps will be proportional with the difference between the speed of the conveyors 7*a*, 8*a* on the one hand and the speed of the web 6 on the other hand. Highly accurate adjustments of the width of such gaps can be achieved by the dabbing device 57, i.e., by actuating the adjusting mechanism 62 so as to move the pulleys 51, 52 about the shaft 58, either clockwise or in a counterclockwise direction. The adjusting mechanism 62 can be operated while the apparatus is in use. Such precise adjustments are desirable because this ensures that the intercepting device 9 will not cause a relatively weak web to tear prior to complete separation of a sheet 106 from its leader, i.e., the apparatus is more likely to make clean cuts and to ensure that the width of the gaps between successive sheets is sufficient to prevent any interference on the part of a preceding sheet with the advancement of the leader of the web 6 and/or with advancement of the next-following sheet.

The automatic adjustment of intercepting device 9 with reference to the cross cutter 1 in response to changes in the speed of the machine which embodies the improved apparatus is carried out as follows:

As long as the speed of the shaft 3*a* exceeds a value at which the intensity of the signal generated by the tachometer generator 83 is higher than the intensity of reference signal furnished by the source 84, the solenoid of the valve 74 remains deenergized, the nipple 78 is connected with the source 81 of pressurized fluid, and the nipple 79 connects the corresponding chamber of the cylinder 17 with the atmosphere via valve 74. This means that the piston rod 19 assumes its extended position and maintains the walls 24 with the entire intercepting device 9 in the upper left-hand end positions in which the inlet 61 is located substantially at the level of the path which is defined by the cross cutter 1. The extension 93 of the illustrated wall 24 abuts against the tip of the screw 91.

If the speed of the machine is reduced to a value at which the intensity of the signal from the tachometer generator 83 is less pronounced than that of the reference signal from the source 84, the stage 77 transmits a signal which is amplified at 76 and energizes the solenoid of the valve 74. The valving element of the valve 74 changes its position so that the source 81 is connected with the nipple 79 and the nipple 78 connects the corresponding chamber of the cylinder 17 with the atmosphere. Consequently, the piston rod 19 is retracted, the lever 22 is caused to pivot in a clockwise direction, as viewed in the drawing, and the entire intercepting device 9 descends from the illustrated first or higher level to a second or lower level until the extension 93 engages and is arrested by the tip of the screw 92. For example, the nominal or rated speed of the paper web 6 may equal or closely approximate 80 meters per minute; if the speed of the web 6 is less, the solenoid of the valve 74 is energized and effects a movement of the device 9 to the lower level. The guide slot 29 ensures that the inlet 61 of the device 9 descends along a path which slopes downwardly and to the right, as viewed in the drawing.

When the speed of the machine is increased again, i.e., when the speed of the web 6 and of the sheets 106 rises to or above the rated value, the signal at the output of the stage 77 disappears and the solenoid of the valve 74 is deenergized. This causes the valving element of the valve 74 to reassume the illustrated position so that the source 81 is again connected with the left-hand chamber of the cylinder 17. Consequently, the piston rod 19 is expelled and pivots the lever 22 in a counterclockwise direction so as to return the intercepting device 9 to the illustrated upper left-hand end position in which the inlet 61 is close to the cross cutter 1 and is located at the general level of the path defined by the knife holders 2 and 3. Thus, the extension 93 of the illustrated wall 24 returns into abutment with the screw 91.

An important advantage of the improved apparatus is that the leaders of successive sheets 106 are automatically caused to enter the path which is defined by the conveyors *7a, 7b* forming part of the intercepting device 9 irrespective of eventual fluctuations of the speed of the web 6 within a rather wide range. Thus, an operator must properly select the position of the intercepting device 9 with reference to the nip of the knife holders 2 and 3 only once (e.g., when the web 6 is advanced at the nominal or rated speed); from then on, the position of the device 9 is adjusted automatically by the shifting means 14 as soon as the speed of the web 6 increases or decreases. The extent of adjustment of the intercepting device 9 can be readily selected in such a way (by appropriate positioning of the adjustable screws 91 and 92) that the device 9 assumes an optimum position with reference to the cross cutter 1 within the entire contemplated range of speeds of the web 6.

It has been found that the aforedescribed mounting of the intercepting device 9 (so that the inlet 61 or the entire device 9 has a vertical component of movement in response to operation of the motor 16) is especially suited to ensure proper positioning of the entire intercepting device 9 for reception of the leaders of successive sheets 106 irrespective of the extent of fluctuations of the speed of the web 6. It has further been found that it normally suffices to adjust the intercepting device 9 only once in response to deceleration and only once in response to acceleration of the web 6. Thus, when the tachometer generator 83 generates a signal whose intensity or another characteristic indicates that the speed of the web 6 has dropped below a given standard or rated value, the elements 76 and 77 transmit a signal which causes the shifting unit 14 to move the inlet 61 to a lower level. On the other hand, the shifting unit 14 will move the inlet 61 to a higher level (namely, to the general level of the path which is defined by the knife holders 2 and 3) when the signal from the tachometer generator 83 indicates that the speed of the web 6 has risen above the standard or rated value.

The position of the intercepting device 9, while the web 6 is driven at the standard or rated speed, will depend on a variety of parameters, particularly upon the composition of the material of the web 6, the weight of the leader of the web, the width of the web, the flexibility of the web and/or others.

The improved apparatus is susceptible of many additional modifications without departing from the spirit of the invention. For example, the pneumatic motor 16 of the shifting unit 14 can be replaced by a hydraulic motor or by any other motor which is capable of rocking the lever 22 to a desired extent in a clockwise or counterclockwise direction. Furthermore, the tachometer generator 83 can be replaced by other speed monitoring means and the monitoring means can be designed and positioned to detect the speed of the sheets, i.e., to ascertain the speed of sheets 106 directly rather than indirectly through the medium of a rotary or otherwise movable component of the cross cutter 1. Still further, the axial positions of the screws 91 and 92 can be changed in automatic response to changes in the speed of the knife holders 2, 3, in response to changes of the composition of the web 6 and/or in response to other deviations from standard operation with standard web stock.

Cross cutters of the type suitable for use in the apparatus of the present invention are disclosed, for example, in U.S. Pat. Nos. 4,201,102 and 4,255,998 granted to Willy Rudszinat. The disclosures of these patents are incorporated herein by reference.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for manipulating webs consisting of paper or other flexible material, comprising severing means for subdividing a running web of paper or the like into a series of discrete sheets each of which has a leader normally advancing along a first path, said severing means including at least one mobile component and means for moving said component at a plurality of speeds; a sheet intercepting device adjacent to said first path and including a pair of sections defining a second path wherein successive sheets of said series are transported in a predetermined direction; shifting means actuatable to adjust said intercepting device with reference to said severing means so as to change the position of said second path relative to said first path; and means for actuating said shifting means in response to changes in the speed of said component.

2. The apparatus of claim 1, wherein said sections include an upper section and a lower section.

3. The apparatus of claim 1, wherein said shifting means comprises motor means and said actuating means includes means for operating said motor means.

4. The apparatus of claim 1, further comprising guide means for said intercepting device.

5. The apparatus of claim 4, wherein said guide means is stationary.

6. The apparatus of claim 4, wherein said guide means is arranged to confine said intercepting device to movement having a vertical component.

7. The apparatus of claim 1, wherein said actuating means comprises signal generating means for monitoring the speed of said component and means for initiating the actuation of said shifting means when the signals generated by said monitoring means denote that the speed of said component deviates from a predetermined value.

8. The apparatus of claim 7, wherein said component is a rotary component.

9. The apparatus of claim 7, wherein the speed of the sheets of said series is indicative of the speed of said component and said monitoring means includes means for ascertaining the speed of the sheets.

10. The apparatus of claim 7, wherein said initiating means includes means for comparing said signals with a reference signal denoting said predetermined speed and for generating signals for transmission to said shifting means when the characteristics of signals generated by said monitoring means deviate from the corresponding characteristics of said reference signal.

11. The apparatus of claim 1, wherein said intercepting device has an inlet for admission of the leaders of successive sheets of said series into said second path and said shifting means includes means for moving said inlet to a selected one of a plurality of different levels.

12. The apparatus of claim 11, wherein said levels include a first level at which said inlet is located at least substantially at the level of said first path and a lower second level.

13. The apparatus of claim 12, wherein said actuating means is operative to effect the movement of said inlet to said first level, through said shifting means, when the speed of said component exceeds a predetermined value and to effect the movement of said inlet to said second level when the speed of said component drops below such value.

14. The apparatus of claim 1, further comprising means for limiting the extent of adjustability of said intercepting device by said shifting means.

15. The apparatus of claim 14, wherein said limiting means is adjustable so as to allow for changes in the extent of adjustability of said intercepting device.

16. The apparatus of claim 1, wherein said shifting means includes a fluid-operated motor.

17. The apparatus of claim 16, wherein said motor is a pneumatic motor.

18. The apparatus of claim 16, wherein said motor includes a double-acting cylinder and piston unit.

19. The apparatus of claim 1, further comprising additional shifting means including means for moving at least one of said sections relative to the other of said sections and said severing means.

* * * * *